US008496247B2

(12) United States Patent
Richards et al.

(10) Patent No.: US 8,496,247 B2
(45) Date of Patent: Jul. 30, 2013

(54) ENCODER IDLER ROLL

(75) Inventors: Paul N Richards, Fairport, NY (US); Lloyd A Williams, Mahopac, NY (US); Joannes N M Dejong, Hopewell Junction, NY (US); Matthew Dondiego, West Milford, NJ (US); Douglas K Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 955 days.

(21) Appl. No.: 12/561,294

(22) Filed: Sep. 17, 2009

(65) Prior Publication Data

US 2011/0062659 A1 Mar. 17, 2011

(51) Int. Cl.
*B65H 5/02* (2006.01)
*B65H 5/00* (2006.01)
*B65G 13/02* (2006.01)

(52) U.S. Cl.
USPC ..... 271/272; 271/264; 198/780

(58) Field of Classification Search
USPC ..... 271/265.01, 272, 264, 275, 314; 198/624, 198/780–791
See application file for complete search history.

(56) References Cited

U.S. PATENT DOCUMENTS

| | | | | |
|---|---|---|---|---|
| 6,141,515 | A * | 10/2000 | Takeda et al. | 399/167 |
| 6,533,268 | B2 | 3/2003 | Williams et al. | |
| 6,575,458 | B2 | 6/2003 | Williams et al. | |
| 6,736,394 | B2 | 5/2004 | Herrmann et al. | |
| 6,868,244 | B2 * | 3/2005 | Koide | 399/167 |
| 7,509,074 | B2 * | 3/2009 | Yokoyama et al. | 399/162 |
| 7,530,256 | B2 | 5/2009 | DeJong et al. | |
| 7,641,192 | B2 * | 1/2010 | Ouchi | 271/266 |
| 8,290,399 | B2 * | 10/2012 | Ohkushi et al. | 399/121 |
| 2003/0021613 | A1 * | 1/2003 | Koide | 399/167 |
| 2005/0263958 | A1 * | 12/2005 | Knierim et al. | 271/272 |
| 2006/0210324 | A1 * | 9/2006 | Kuma et al. | 399/301 |
| 2008/0257504 | A1 * | 10/2008 | Marchetto et al. | 160/311 |
| 2009/0027043 | A1 * | 1/2009 | Pelak et al. | 324/207.2 |
| 2009/0212490 | A1 * | 8/2009 | Sugahara | 271/265.01 |
| 2009/0322020 | A1 * | 12/2009 | Iwata et al. | 271/314 |
| 2010/0034565 | A1 * | 2/2010 | Ashikawa et al. | 399/302 |

OTHER PUBLICATIONS

U.S. Appl. No. 12/495,233, filed Jun. 6, 2009, and entitled "Sheet Transport System with Modular Nip Release System" by Paul N. Richards, et al.
U.S. Appl. No. 12/433,008, filed Apr. 30, 2009, and entitled "Moveable Drive Nip" by Paul N. Richards, et al.
U.S. Appl. No. 12/433,069, filed Apr. 30, 2009, and entitled "Moveable Drive Nip" by Paul N. Richards, et al.

* cited by examiner

*Primary Examiner* — Patrick Cicchino

(57) ABSTRACT

An encoder idler roll includes an integral idler roll/encoder structure that forms an enclosed housing with a portion of the surface of the idler roll becoming the inner race for the encoder, as well as, the media encoding surface. Additionally, this integral idler/encoder configuration minimizes run out, improves tolerances between parts and stabilizes clearances between the idler roll and its support shaft.

7 Claims, 8 Drawing Sheets

ENCODER IDLER ROLL

Cross-reference is hereby made to commonly assigned and U.S. application Ser. Nos. 12/495,233, filed Jun. 6, 2009, and entitled "Sheet Transport System with Modular Nip Release System" by Paul N. Richards, et al., now U.S. Pat. No. 8,196,925; 12/433,008, filed Apr. 30, 2009, and entitled "Moveable Drive Nip" by Paul N. Richards, et al., now abandoned; and 12/433,069, filed Apr. 30, 2009, and entitled "Moveable Drive Nip" by Paul N. Richards, et al., now US Publication No. 20100276877. The aforementioned application disclosures are incorporated herein by reference.

This disclosure relates to paper handling systems for xerographic marking and devices, and more specifically, relates to an improved encoder idler roll used in media or sheet transport.

Document processing devices typically include one or more sets of nips used to transport media (i.e., sheets) within each device. A nip provides a force to a sheet as it passes through the nip to propel it forward through the document processing device. Depending upon the size and the sheet that is being transported, one or more nips in a set of nips might not contact the sheet as it is transported.

FIG. 1A depicts a top view of a portion of an exemplary document processing device known in the art. As shown in FIG. 1A, the document processing device 100 includes three sets of nips 105*a-b*, 110*a-b*, and 115*a-b*. The first set of nips 105*a-b* are used to transport a sheet; the second set of nips 110*a-b* are used to perform sheet registration; and the third set of nips 115*a-b* are used to transport a sheet in a process direction. Although two nips are shown for each set of nips, additional or fewer nips can be used. In some cases, additional nips are used to account for variations in sheet size during the transport or registration processes.

As shown in FIG. 1B, each nip in a set of nips, such as, 115*a-b*, includes a drive wheel, such as, 125, and an idler wheel, such as, 130. A normal force is caused at each nip by loading the idler wheel 130. Friction between the sheet and each nip 115*a-b* is used to produce a normal force that propels the sheet in a process direction. Typically, each idler wheel 130 is mounted independently from the other idler whets in a set of nips.

Efforts have been ongoing in this technological art for more effective sheet registration for xerographic devices, such as, printers, copiers, facsimile devices, scanners, and the like. The related art includes translation electronic registration (TELER or ELER) sheet deskewing and/or side registration systems, such as, U.S. Pat. No. 6,575,458 to Williams et al., and U.S. Pat. No. 6,736,394 to Herrmann et al. In either ELER or TELER systems, initial or incoming sheet skew and position may be measured with a pair of lead edge sensors, and then two or more ELER or TELER drive rolls may be used to correct the skew and process direction position with an open loop control system in a known manner. The drive rolls have two independently driven, spaced apart, inboard and outboard nips. Some ELER systems use one servomotor for process direction correction and another motor (e.g., a stepper motor) for the differential actuation for skew correction, as variously shown in U.S. Pat. Nos. 6,575,458 and 6,533,268 to Williams et al. Other ELER systems have separate servo or stepper motors independently driving each of the two laterally spaced drive nips for process direction registration and sheet skew registration.

Most TELER and ELER systems use a frictional force drive nip to impart velocities to a sheet. A nip includes a motor driven elastomeric surface wheel or drive roll and a backup wheel or idler roll that is spring loaded against the drive roll to provide sufficient normal force for a normal non-slip drive of the sheet. A well known example of the drive roll surface is a urethane material. In contrast, the idler roll is usually a hard substantially inelastic material that can be metal or hard plastic. The angular velocity of the drive nip has typically been measured with an encoder mounted on the drive roll/shaft assembly, idler roll or on the servo or stepper motor driving the drive roll directly or through a transmission as in a timing belt drive. For example, see U.S. Pat. No. 7,530,256 B2 that discloses systems and methods to calibrate a sheet velocity measurement derived from a drive nip system incorporating idler encoders. This patent and all of the patents mentioned hereinabove and the references cited therein are included herein by reference to the extent necessary to practice the present disclosure.

The encoders being used with idler rolls have exposed encoder discs and sensors which become contaminated in a printing environment with contaminants, such as, toner, dirt, etc., and over time create functional and life issues.

In answer to this problem and disclosed herein is an improved encoder idler roll that includes an integral idler roll/encoder structure in an enclosed housing with a portion of the surface of the idler roll becoming an inner race for the encoder, as well as, the media encoding surface. Additionally, this integral idler/encoder configuration minimizes run out, improves tolerances between parts and stabilizes clearances between the idler roll and the shaft on which it is mounted.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 8:
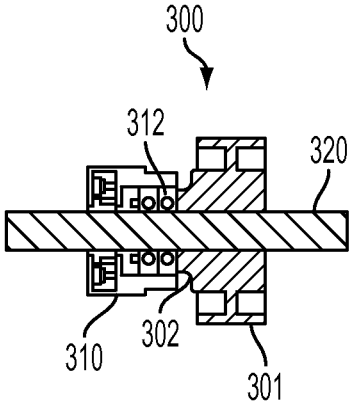
Figure 9:
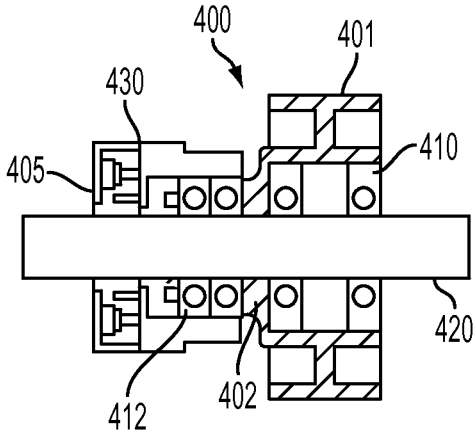

FIG. 8 depicts an enlarged partial cross-section of an alternative improved encoder idler roll for use in a sheet transport system showing an idler roll fixed to a rotating shaft and a fixed encoder; and FIG. 9 depicts an enlarged partial cross-section of another alternative improved encoder idler roll for use in a sheet transport system showing an Independently driven Idler (i.e. by drive roll) and a rotating shaft.

Turning now to further detail of the FIGS. 2 and 3, the sheet transport system 200 includes an improved encoder/idler 280 that will be described in detail hereinafter, and a drive module 212. The drive module includes a drive roll 210, a drive motor 215, and a transmission device for operably connecting the drive motor 215 to the drive roll 210.

The idler wheel 280 is a nip component designed to provide a normal force against a sheet that is being transported by the sheet transport system 200 in order to enable the sheet to be propelled by the drive wheel 210. The idler roll 280 may comprise a non-compliant material, such as, hard plastic. The encoder/idler roll 280 may rotate around a shaft 234. Also, the shaft may be secured to resist movement of the encoder/idler roll 280 away from the drive roll.

The drive roll 210 is another nip component that is designed to propel a sheet 211 that is being transported by the sheet transport system 200. The drive roll 210 may comprise a compliant material, such as, rubber, neoprene, or the like. Rotation of the drive roll moves the sheet through the sheet transport system 200.

Figure 3:
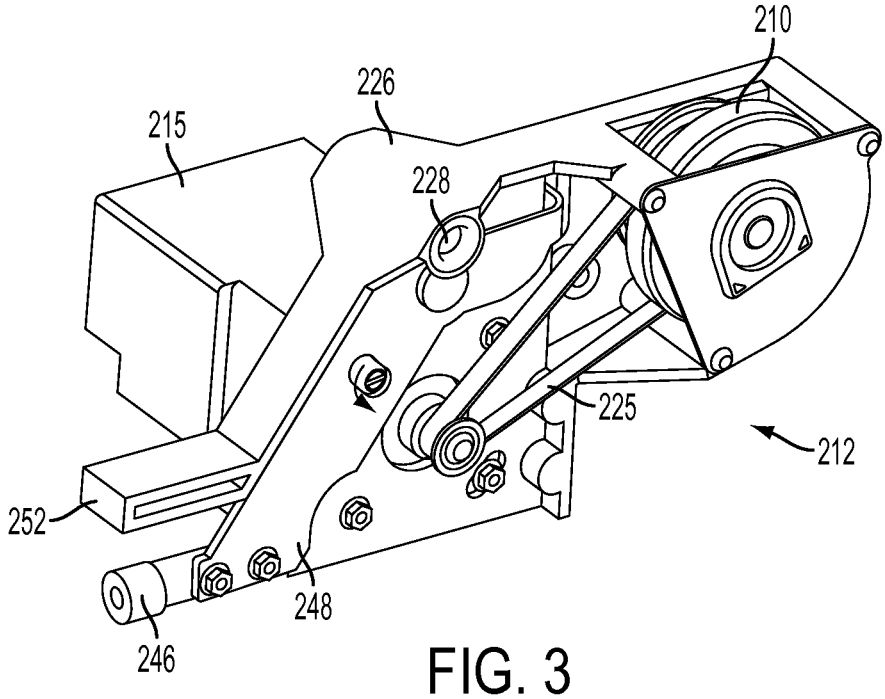
FIG. 3 depicts a front perspective view of a drive module used in the used in the sheet transport system of FIG. 2.
Figure 4:
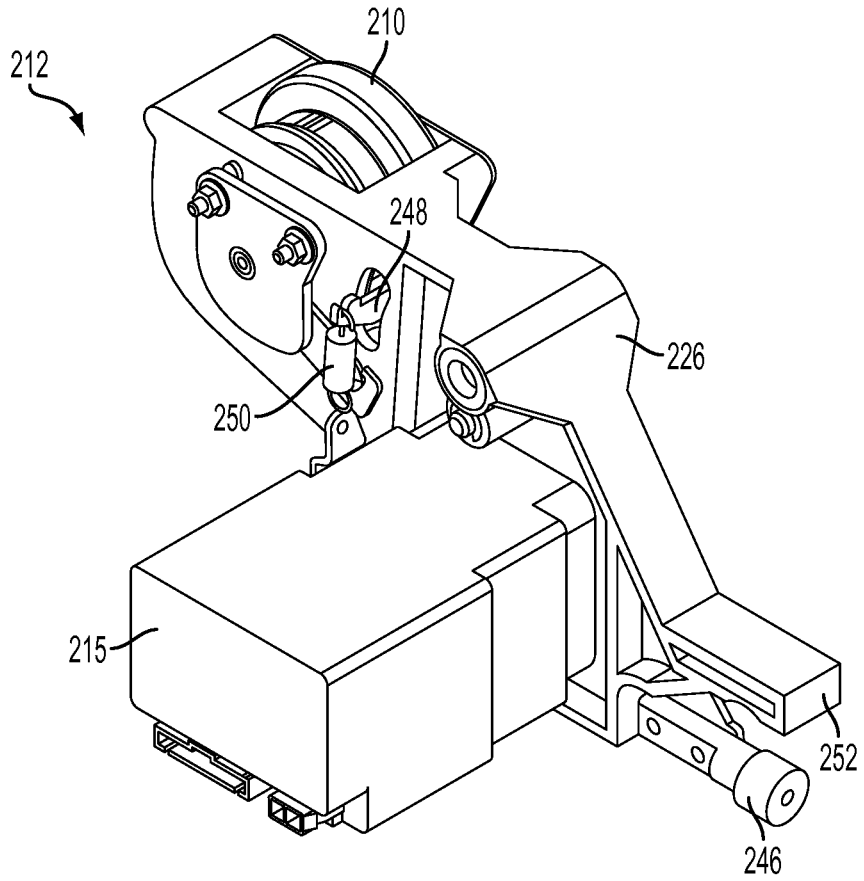
FIG. 4 depicts a back perspective view of the drive module of FIG. 3.
Figure 5:
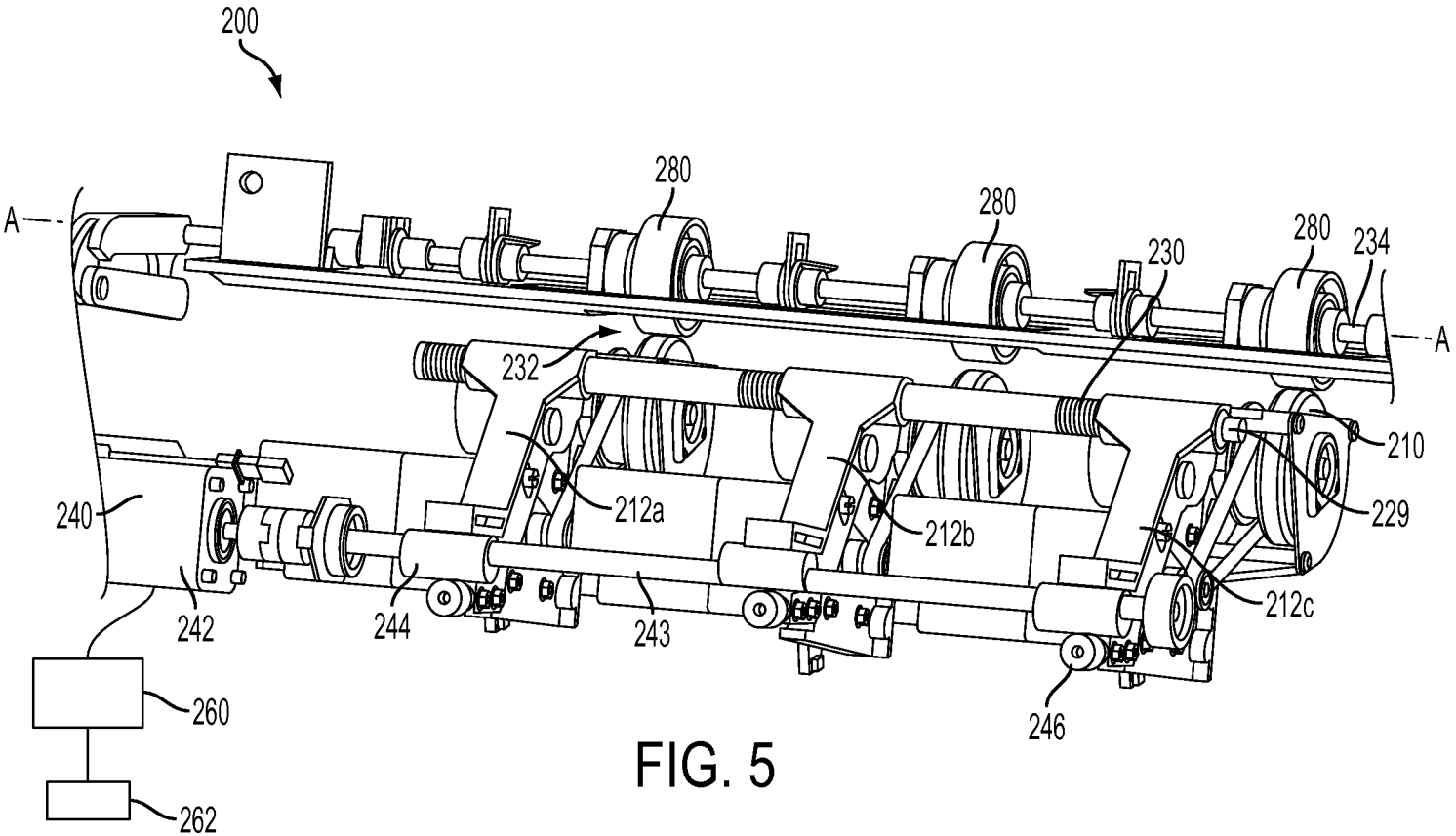
FIG. 5 depicts a perspective view of the sheet transport system showing an engagement of drive rolls with improved encoder/idler rolls in transport accordance with the present disclosure.

With reference to FIGS. 3-5, in addition to the drive roll 210, the drive module 212 includes a drive motor 215, such as, a stepper motor, DC motor or the like. The drive module 212 may also include a transmission system 225 to operatively connect the drive roll 210 to the drive motor 215. The transmission system 225 may include a belt drive; however, other transmission system 225, such as, gear trains, are known to those of ordinary skill in the art and intended to be included within the scope of this disclosure. The drive module 212 may further include a frame 226 on which the drive roll 210 is rotatably supported. The frame 226 may also support the drive motor 215. The frame 226 may include a through hole 228 which may receive therein a support shaft 229. The drive module 212 and all of its components may be pivotally supported on the shaft 229. Each drive module 212 may be engaged by a drive module biasing device 230 in the form of a compression spring which is disposed on the shaft 229. The drive module biasing devices 230 urge the drive modules 212 to remain in their proper position along the support shaft 229. The drive modules 212 are discrete assemblies that may be installed as a unit.

Figure 6:
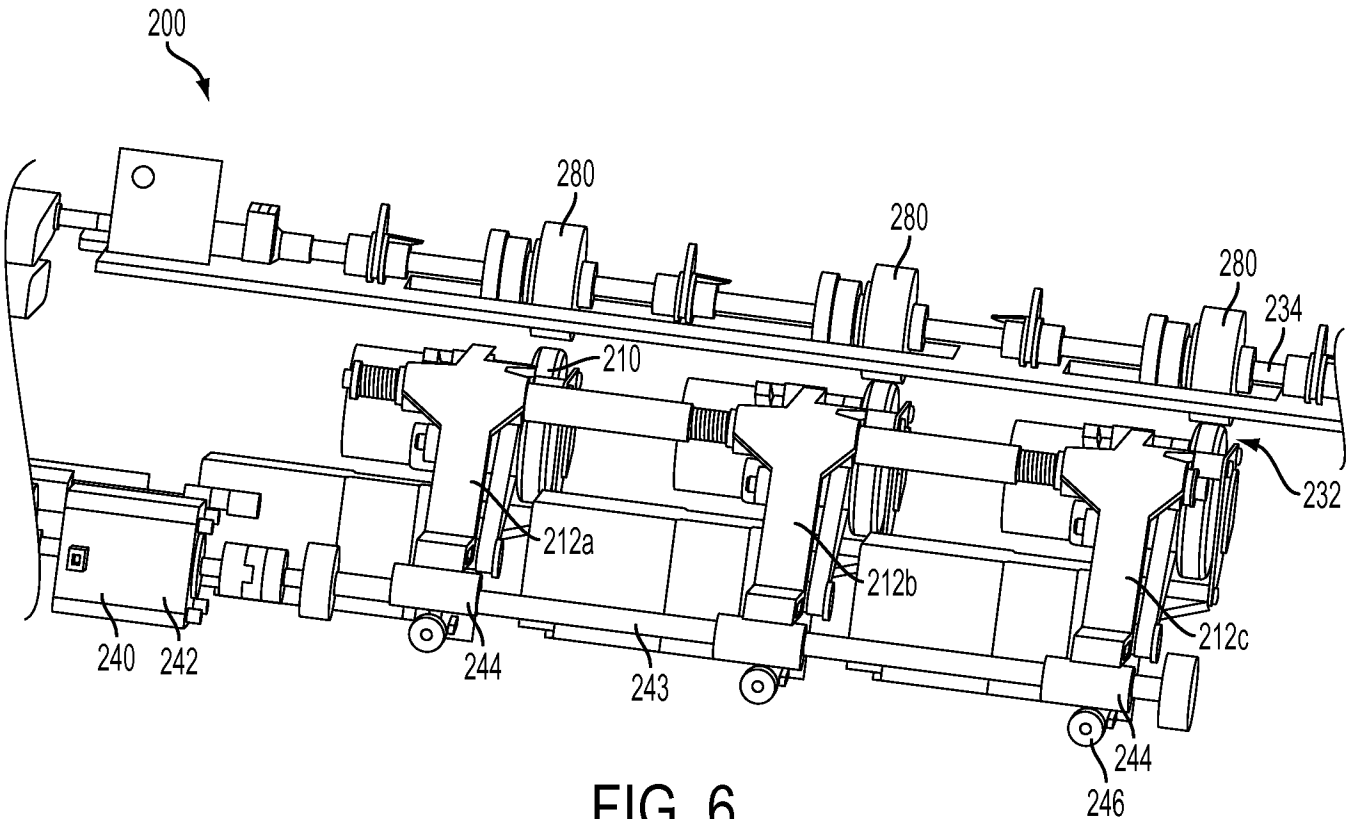
FIG. 6 depicts a perspective view of the sheet transport system showing an alternative engagement of the drive rolls with the improved encoder/idler rolls of the present disclosure.

With reference to FIGS. 5 and 6, a plurality of similarly formed drive modules 212 may be arranged in a row with each being pivotally supported on the support 229. The drive modules 212 are preferably mounted such that they may pivot independent of each other. A plurality of encoder/idler rolls 280 may also be arranged in a row with the drive rolls 210 of the drive modules corresponding tone of the encoder/idler rolls 280, thereby forming a plurality of nips 232. The encoder/idler rolls 280 may be located on a common shaft 234 around which each encoder/idler roll rotates. Accordingly, a sheet passing through the sheet transport 200 may be contacted at more than one point.

Each drive module 212 and the drive roll 210 associated therewith may be independently positioned between an open and closed position. Such positioning of the drive rolls 210 may be achieved by an actuator 240. Actuator 240 is generally a mechanical device used to move or control a mechanism or system. The actuator 240 may be used to move or control the location of the drive roll 210 with respect to a sheet that is transported by the sheet transport system 200. Actuator 240 permits the drive modules 212 to be independently controlled to change the open and closed operating position of the drive rolls 210. Accordingly, the actuator is capable of crating different operating conditions, with each operating condition being distinguished by which drive wheels are in the open and closed position.

Actuator 240 may include a rotary drive 242 connected to one end of a camshaft 243. The rotary drive 242 may include a motor, such as, a stepper motor or DC motor, which is capable of rotating in a clockwise and counterclockwise motion. The rotary drive 242 may be capable of rotating through 270 degrees, although other ranges of motion are contemplated. The camshaft 243 may include a plurality of cams 244 secured thereon. The cams 244 are spaced along a length of the camshaft 243. The cams are positioned to selectively engage followers 246 disposed on the drive modules. The movement of the cams 244 causes the followers to move and in turn cause the drive rolls 210 to pivot between the open and closed position. Alternatively, a plurality of actuators may be employed with each drive module 212 being controlled by a separate actuator. In the closed position, the sheet is gripped between the drive roll 210 and encoder/idler roll 280 thereby permitting the sheet to be propelled. When the drive roll 210 is in the open position, the drive roll 210 is moved away from the encoder/idler roll 280, therefore the sheet is not gripped by the drive and encode/idler rolls and is not propelled. With the drive roll moved out of the sheet path, drag on the sheet is reduced as it is passed through the sheet transport system 200.

Figure 1A:
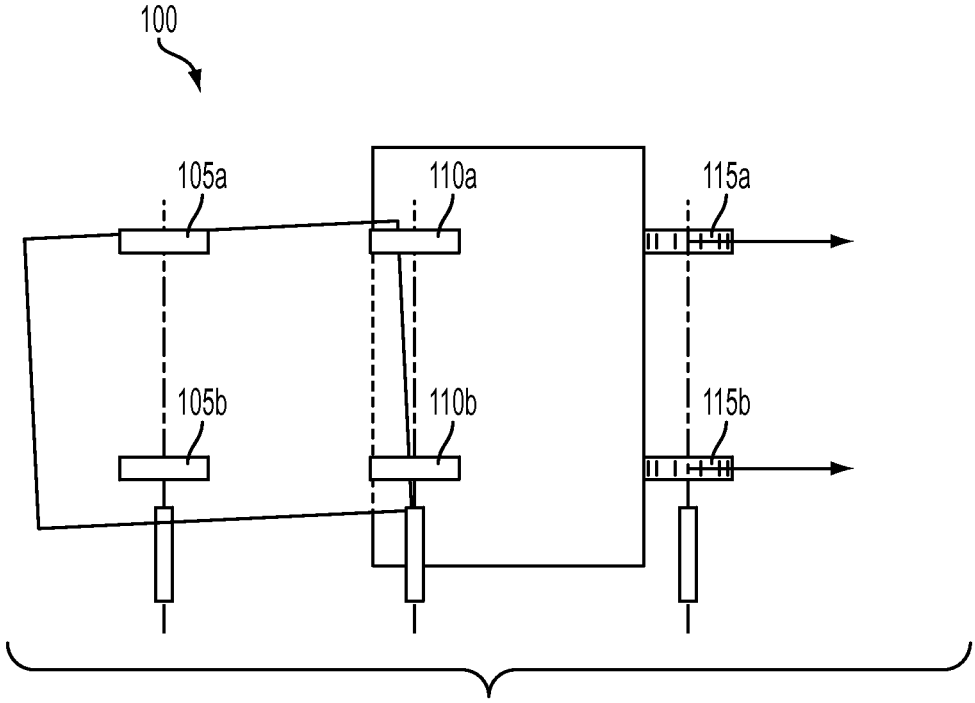
FIG. 1A PRIOR ART
FIG. 1A is a top view of a portion of a conventional document processing device.
Figure 1B:
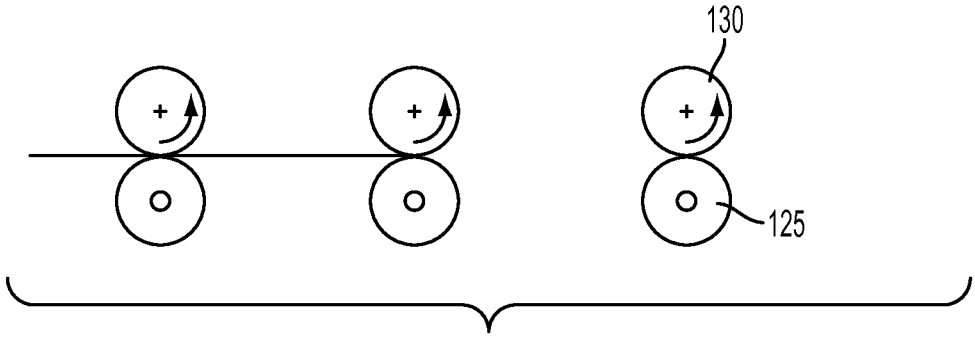
FIG. 1B PRIOR ART
FIG. 1B is a side elevational view of a sheet transport system for a conventional document processing device.
Figure 2:
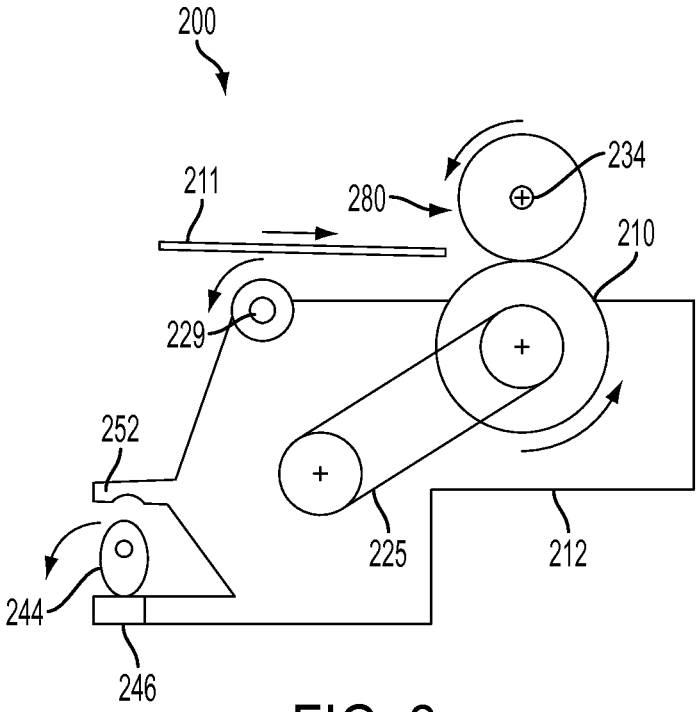
FIG. 2 depicts a side elevational view of a sheet transport system for a document processing device according to an embodiment.

With reference to FIGS. 2, 3 and 4, the follower 246 of each drive module 212 may be secured to a first end of a bracket 248 pivotally secured to the drive module frame 226. A biasing derived 250 may be disposed between the bracket 248 and frame 226. The biasing device 250 in the form of a spring may be secured to the second end of the bracket and to the frame 226. Engagement of the follower by the cam 244 moves the follower 246 and the bracket 248 relative to the frame 226. The moving bracket pulls on the biasing device 250 which in turn pivots the frame 226 and drive roll 210 secured thereto to the closed position. When the drive roll 210 engages the corresponding encoder/idler roll 280, the drive roll and frame stop pivoting, but the follower 246 and bracket 248 continue to be driven by the cam 244. The further movement of the bracket 248 loads the biasing device 250 and creates a normal force between the drive roll 210 and the encoder/idler 280. When the drive module 212 is to be moves to the open position, the cam 244 may be rotated such that the cam moves away from the follower 246. Upon such movement, the normal force will be decreased as the bracket 248 moves to reduce tension on the biasing device 250. Upon further rotation of the cam 244, the cam may engage a projection 252 (FIG. 2) extending from the frame and disposed above and spaced from the follower 246. The engagement of the cam 244 with the projection 252 moves the drive roll 210 away from the idler roll 280, thereby opening the nip 232.

As shown in FIG. 5, in three drive modules including an inboard 212*a*, a middle 212*b*, and an outboard 212*c* module, the rotary drive 242 of the actuator may move to a first position rotating the camshaft 243 to cause a first response condition. In this first response condition, the cams engage the inboard 212*a* and outboard 212*c* modules to drive the followers 246 downwardly, thereby raising the drive rolls 210 into engagement with the corresponding encoder/idler rolls 280. With the drive rolls of the inboard 212*a* and outboard 212*c* modules in the closed position, a sheet extending between those drive rolls may be operated upon by the transport system 200. The middle module 212*b* may remain in the open position. This permits sheets having a width extending across the inboard and outboard encoder/idler rolls to be engaged at two points and driven through the transport system 200.

The actuator 240 may create a second response condition. As shown in FIG. 6, the rotary drive 242 of the actuator may be moved to a second position such that the camshaft engages the followers of the middle 212*b* and outboard 212*c* drive modules such that he drive rolls engage the corresponding encoder/idler rolls 280. The follower of the inboard drive module 212*a* may not be urged by the cam 244. Instead, the cam 244 may engage the frame projection 252 moving the drive roll away from the corresponding encoder/idler roll such that the inboard drive module 212*a* assumes the open position. With the drive rolls of the middle outboard drive modules in the closed position, sheets having a width that extends between these two drive rolls may be engaged and moved through the nip. This second response condition can be used to accommodate sheets having widths more narrow than the first response condition.

Accordingly, by changing the position of the actuator 240, sheets of differing widths may be accommodated. Drive modules 212 not necessary for transporting the sheet may be moved to the open position, thereby reducing drag on the sheet and wear on the nip components.

The actuator rotary drive may be moves to a third position such that the cams permit all of the drive modules 212 to assume the open position (not shown). Therefore, the sheet is released from the nip permitting the sheet to be transferred or acted upon by a registration device.

The opening and closing of the nips 232 is achieved by moving the drive rolls 210 between the open and closed position. During the opening and closing of he nip, the position of he axis of rotation (A-A in FIG. 5) relative to the drive roll of the first and second encoder/idler rolls 280 remains generally unchanged. The opening and closing of the nips does not include movement of the encoder/idler rolls 280. Therefore, the alignment in all direction of the encoder/idler rolls 280 is not compromised when the nip is opened and closed.

With reference to FIG. 5, the actuator 240 may be operably connected to a controller 260 which provides signals to the actuator 240 to affect the actuator position. A sheet with determinator 262, which may include a sheet sensor or an input device, may determine the width of the sheet to pass through the sheet transport system. The determinator 262 may cooperate with the controller 260 to position the drive modules 212 in the desired position for the width of the sheets entering the nips.

Figure 7:
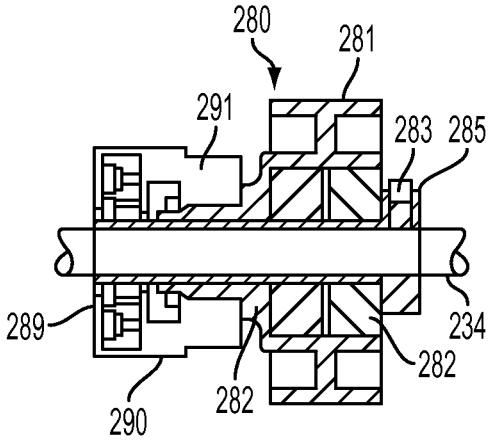
FIG. 7 depicts an enlarged partial cross-section of the improved encoder idler roll used in the sheet transport system of FIG. 5.

Turning now to FIG. 7 and the improved encoder/idler roll 280 also shown in FIGS. 5 and 6 and in accordance with the present disclosure; an integral unit is disclosed that includes an idler roll 281 and an encoder 290. Integral encoder/idler unit 280 is mounted onto shaft 234 and enclosed to the printing environment by a seal member 289 and laterally or orthogonally extending annular portion 282 and of idler roll 281 and inner race 285 to prevent contaminants, such as, toner and dirt from affecting the life and performance of the encoder/idler roll. In addition, this integral configuration provides a reduction in mounting tolerances, elimination of component functional and life problems and improves operating tolerances, i.e., runout, etc. The plurality of encoder/idler rolls shown in FIGS. 5 and 6 are identical in configuration and function to encoder/idler roll 280 of FIG. 7.

Integral encoder/idler roll 280 comprises an idler roll 281 with a portion thereof positioned over ball bearings 282 and attached to rotate around shaft 234 with an attachment device, such as, a screw 283. Flange portion or member 282 extends orthogonally from idler roll 281 along shaft 234 and into encoder 290. Flange portion 291 of encoder 290 extends in mating relationship with flange portion 282 of idler roll 280 in order to together with seal member 289 and inner race 285 form an enclosed housing with shaft 234 against outside elements.

Rotary encoder 290 is stationary mounted on shaft 234 and provides output signals to controller 260, shown in FIG. 5, directly signaling the rotation thereof. That is, accurately independently signaling the respective rotary position of the idler 280 which is mating with nip normal force with frictional drive sheet driver roll 210. This idler roll is not subject to any driving forces, and can be hard metal or plastic of an elastomeric material (unlike the driver roll 210). Thus, the idler roll need not be deformed by nip forces, or any slip relative to sheet 211. Thus, the encoder/idler roll 280 can have rotational velocity directly corresponding to the actual surface velocity of the sheet 211 in nip 280, 210. Thus, the respective encoder/idler rotation accurately corresponds to its engaged sheet 211 movement, and that information can be accurately recorded by conventional pulse train output signals sent to controller 260. This encoder signal can also be compared with known information in comparative software or circuitry in the controller 260, or elsewhere. In this configuration, the idler becomes the inner race for the encoder and also the media encoding surface.

Alternatively, as shown in FIG. 8, an integral encoder/idler roll unit 300 comprises an idler roll 301 fixedly attached by conventional means to rotate with rotatable shaft 320. Flange portion or member 302 extends orthogonally from idler roll 301 along shaft 320 and abuts against the housing of ball bearings 312 of fixed encoder 310. Thus, flange portion 302 of idler roll 301 together with seal member 305 and shaft 320 forms an enclosed housing against machine contaminants.

Another alternative embodiment in FIG. 9, discloses and integral encoder/idler roll unit 400 that comprises an idler roll 401 rotatably attached by ball bearings 410 to rotate independently about rotatable shaft 420 that is driven by conventional means. Idler roll 401 is driven by a drive roll, such as, drive rolls 210 in FIG. 5. Flange portion or member 402 extends orthogonally from idler roll 401 along shaft 420 with an inner race portion thereof extending into the housing of ball bearings 412 of fixed encoder 430. As a result, flange portion 402 of idler roll 401 together with seal member 405 and shaft 420 forms an enclosed housing against machine contaminants. Rotary encoder 430 which is stationary and mounted through ball bearings 412 onto rotatable shaft 420 provides output signals to controller 260, shown in FIG. 5. Significantly, with this configuration, idler 401 and shaft 420 can be rotated at two different rotational velocities.

It should now be understood that an improved media drive idle roll assembly has been disclosed that integrates an encoder wheel into an idler roller hub for use in a sheet transport apparatus. The idler becomes the inner race for the encoder and also the media encoding surface. This idler/encoder configuration can be used on a fixed (non-rotating) shaft or a rotating shaft if the idler bearings are removed and the hub fixed to the shaft. This idler with integral encoder has advantages over encoders that are not integral with an idler roller since it is assembled with improved operating tolerances and with other functional improvements. Thus, the major difference of the present disclosure over conventional idler rolls and independent encoders is integrating the encoder wheel into the idler roll hub.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A xerographic system including a sheet transport for moving sheets in a predetermined path, said sheet transport including at least one frictional sheet drive roll and a mating encoder idler roll forming at least one sheet drive nip between said at least one frictional sheet drive roll and said mating encoder idler roll, and wherein said encoder idler roll is an integral unit comprised of an idler roll and an encoder in combination, and wherein said idler roll includes an inner race portion that extends orthogonally with respect to said idler roll and along a support member, and wherein said encoder includes a portion thereof that extends orthogonally with respect to said support member and in mating relationship with said inner race of said idler roll.

2. The xerographic system of claim 1, wherein said encoder idler roll integral unit is configured to be enclosed from contaminants within said xerographic system.

3. The xerographic system of claim 1, wherein said idler roll and said support member are adapted to be driven at two different velocities.

4. The xerographic system of claim 2, wherein said encoder idler roll includes a seal that encloses one end thereof.

5. The xerographic system of claim 1, including a control system, and wherein said control system includes a controller.

6. The xerographic system of claim 5, wherein said encoder is operatively adapted to produce electrical signals corresponding to rotation of said idler roll to said controller.

7. A xerographic system including a sheet transport for moving sheets in a predetermined path, said sheet transport including at least one frictional sheet drive roll and a mating encoder idler roll forming at least one sheet drive nip between said at least one frictional sheet drive roll and said mating encoder idler roll, and wherein said encoder idler roll is an integral unit comprised of an idler roll and an encoder in combination, and wherein said idler roll includes an inner race portion that extends orthogonally with respect to said idler roll and along a fixed support member, and wherein said encoder includes a portion thereof that extends orthogonally with respect to said fixed support member and in mating relationship with said inner race of said idler roll.

* * * * *